United States Patent [19]

Dunn

[11] 4,126,286

[45] Nov. 21, 1978

[54] END CAP FOR CLOTH REEL

[75] Inventor: Richard G. Dunn, Greensboro, N.C.

[73] Assignee: The Real-Reel Corporation, East Providence, R.I.

[21] Appl. No.: 825,664

[22] Filed: Aug. 18, 1977

[51] Int. Cl.[2] ..... B65H 75/06

[52] U.S. Cl. ..... 242/222

[58] Field of Search ..... 242/222, 118.8, 71.8, 242/61; 206/389, 413, 415, 416

[56] References Cited

U.S. PATENT DOCUMENTS

| | | | |
|---|---|---|---|
| 695,062 | 3/1902 | Lonke | 242/222 |
| 1,659,282 | 2/1928 | Scheffey | 242/222 |
| 3,062,368 | 11/1962 | Dunn | 242/222 |

*Primary Examiner*—George F. Mautz

*Attorney, Agent, or Firm*—Barlow & Barlow

[57] ABSTRACT

An end cap for a paperboard reel upon which cloth is to be wound which has its corners rounded instead of sharp so as not to injure cloth with which the reel might come in contact.

4 Claims, 4 Drawing Figures

END CAP FOR CLOTH REEL

BACKGROUND OF THE INVENTION

Cloth reels are usually constructed of cardboard and are provided with protecting end caps at the opposite ends of the paperboard reel construction. These end caps usually consist of a face extending across the end of the cardboard reel with sides folded from the face along opposite broad surfaces of the reel and in some cases, such as in U.S. Pat. Nos. 1,966,191 of July 10, 1934, and 3,341,000 of Sept. 12, 1967, have ends as well as sides folded from the face of the cap. The constructions illustrated in the patents above mentioned have rather sharp square corners formed by the folding of the sides and ends at right angles to the face of the cap and present points which may damage cloth with which the reel may come in contact. In some cases, a tape is used to cover and minimize the sharp points presented.

SUMMARY OF THE INVENTION

The reel of this invention has cardboard stock end caps which eliminate the sharp points formed by conventional constructions mentioned above, by providing flaps on the ends of the cap which are bent with the grain of the cardboard stock to present a rounded surface and these rounded surfaces extend beyond the edges of the side walls of the cap so that no sharp points such as above referred to in the Background of the Invention are presented.

DESCRIPTION OF THE PREFERRED EMBODIMENT

Figure 1:
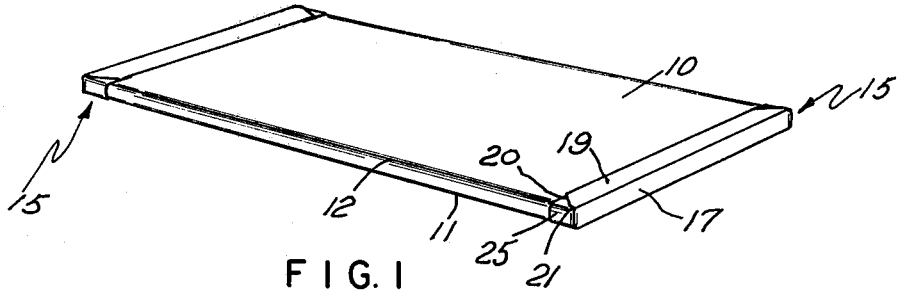
FIG. 1 is a perspective view of a cloth reel with the end caps of this invention on the ends of the reel.

With reference to the drawings FIG. 1 shows at 10 a cardboard formed reel having rounded edges as at 11 and 12. The end portions of this reel are enclosed in end caps designated generally 15 and there is one of these end caps at each end of the reel.

The end caps are die cut from a piece of cardboard in which the grain stock is oriented to extend as shown by the arrow 16 which will be lengthwise of the end cap as it exists alone. The end cap has a front wall designated 17 which exists between the dotted score lines 18 along which the side walls 19 extend for folding into finished position. These side walls are cut at their ends as at 20 at an angle, shown as substantially 45°, from a point to leave a short edge 21 at either end thereof. End walls 25 are located at the ends of the front wall 17 at either end of the front wall and have flaps 26 extending from the end walls as seen in plan in FIG. 2. A slot 27 having a beveled end 28 is formed between the edge portions 21 of the side walls and the flaps 26 for purposes as will presently appear.

Figure 2:
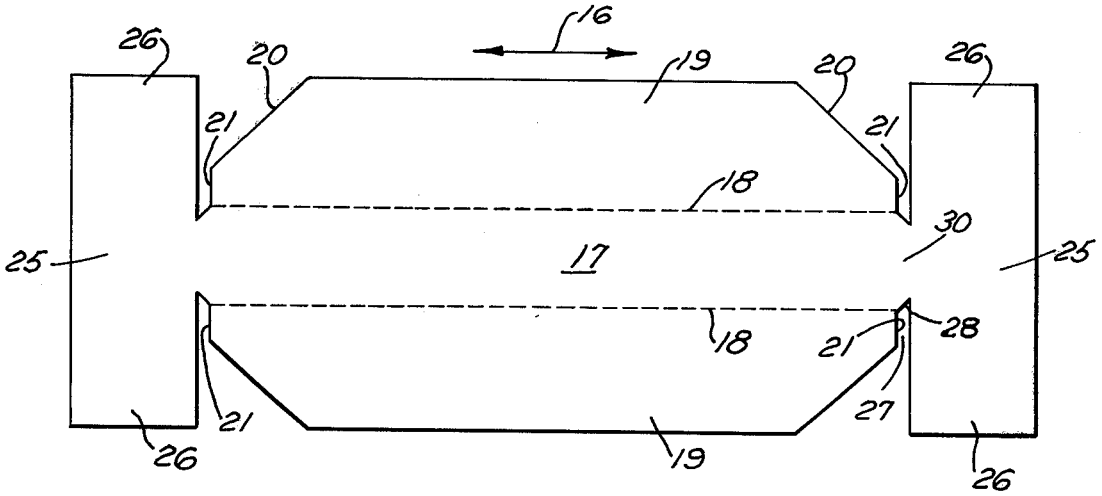
FIG. 2 is a top plan view of the end cap as die cut from a piece of cardboard before being shaped into finished position.
Figure 3:
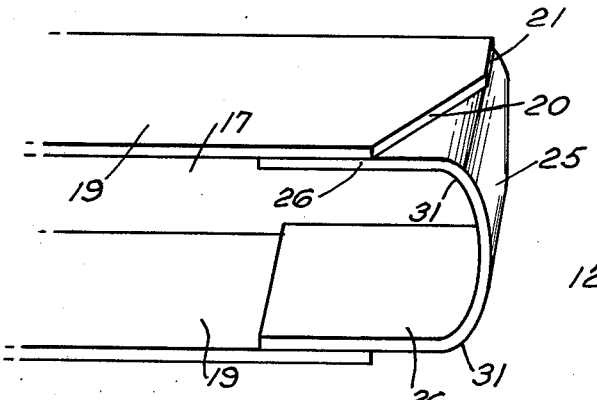
FIG. 3 is a perspective view looking at the inside of the end cap and showing the rounded portion of the end cap presented by reason of the flaps on the end wall.
Figure 4:
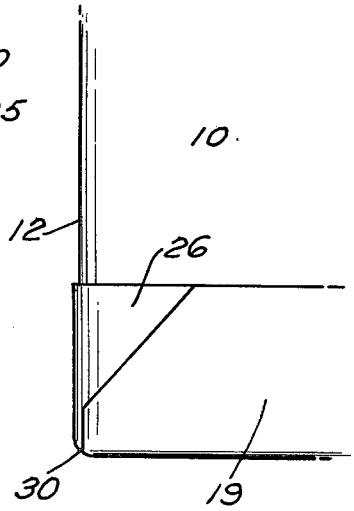
FIG. 4 is a top plan view of a fragmental portion of the reel and end cap showing a further rounding of the end wall at the front wall which is not apparent in FIG. 3.

The blank shown in FIG. 2 is folded up into position such as shown in FIG. 3 by bending the end walls 25 at substantially right angles to the front wall 17 with a slight curvature along the portion 30 (see also FIGS. 2 and 4) and then bending the flaps 26 on an arc 31 from the end wall 25 as seen more particularly in FIG. 3 to a position so that these flaps 26 are substantially parallel and also are at right angles to the face 17. In some cases it may be desirable to form a score line at 30 for ease in handling. The maintenance of the arc 31 is due to the grain orientation of the cardboard stock which otherwise would create a sharp edge. The side walls 19 are then folded along the score lines 18 to extend substantially at right angles to the face 17 and in parallel relation with their end portions overlapping the flaps 26 as seen in FIG. 3. The rounded end wall 25 and its flaps project beyond the ends 21 of the side walls so as to present a rounded surface along the line 31 and which eliminates the formation of any sharp corners or points of the folding of the cap into the formation shown in FIG. 3 from protruding so as to be able to injure cloth that is being handled or with which the reel may come in contact either when the reel is empty or full of cloth. In addition, the slot 27 allows the edge 21 to be removed from the rounded end wall 25 sufficiently to not present an edge near the reel edges 11 and 12 while the chamfered end 28 of the slot allows the flaps 26 to curve without interference.

The cap when shaped into finished position is held in such shape by a fixture or other means and is then positioned on the reel 10 at either end thereof and held by glue or other means to the reel body 10.

I claim:

1. In a cloth reel a body having opposite sides with a longitudinal dimension and a transverse dimension with edges between said sides along the longitudinal dimension and ends between said sides along the transverse dimension, an end cap extending about an end portion of the reel and comprising a front wall along the reel end, side walls integral with the front wall and extending at right angles to the front wall along said opposite sides of the reel, end walls integral with said front wall and extending in a curvature at right angles to the front wall along the reel edges, said end walls having integral flaps extending from opposite sides of the end wall on arcs from the end walls and located along the side walls in a lapping relation therewith and with the arcuate portion projecting transversely of the reel beyond the side walls of the end caps to present a rounded smooth surface corner portion for the reel.

2. In a cloth reel as in claim 1 wherein said end flaps are beneath said cap side walls and along the opposite sides of the reel body.

3. In a cloth reel as in claim 1 wherein the stock grain of the cardboard material of the end cap is so oriented as to extend lengthwise of said front wall continuing into said end wall so that the end wall may be bent from the front wall without creasing.

4. In a cloth reel as in claim 1 wherein the side walls are of lesser length than the front wall.

* * * * *